US006704942B2

(12) United States Patent
Lazarian

(10) Patent No.: US 6,704,942 B2
(45) Date of Patent: Mar. 16, 2004

(54) UNDERGARMENT

(76) Inventor: Rodica Lazarian, 4140 Megan Rd., Duluth, GA (US) 30096

( * ) Notice: Subject to any disclaimer, the term of this patent is extended or adjusted under 35 U.S.C. 154(b) by 0 days.

(21) Appl. No.: 10/024,700

(22) Filed: Dec. 18, 2001

(65) Prior Publication Data

US 2003/0110551 A1 Jun. 19, 2003

(51) Int. Cl.[7] ..... A41B 11/04
(52) U.S. Cl. ..... 2/409; 450/101
(58) Field of Search ..... 2/239, 240, 241, 2/408, 409; 450/116, 115, 149, 154, 155, 101, 112

(56) References Cited

U.S. PATENT DOCUMENTS

| | | | | | |
|---|---|---|---|---|---|
| 2,561,777 | A | | 7/1951 | Bernstein | |
| 2,597,587 | A | | 5/1952 | Lustgarten | |
| 2,697,230 | A | | 12/1954 | Rosecrans | |
| 2,875,763 | A | | 3/1959 | Marchisella | |
| 3,466,667 | A | * | 9/1969 | Rosner | 2/240 |
| 3,470,878 | A | * | 10/1969 | Gottlieb | 450/95 |
| 3,590,823 | A | | 7/1971 | Pope | |
| 3,746,009 | A | | 7/1973 | Cuozzi | |
| 3,756,247 | A | * | 9/1973 | Hand | 450/94 |
| 3,854,978 | A | * | 12/1974 | Campbell et al. | 427/375 |
| 3,974,836 | A | | 8/1976 | Carlson | |
| 4,003,094 | A | * | 1/1977 | Newmar | 2/409 |
| 4,048,818 | A | | 9/1977 | Cueman | |
| 4,180,065 | A | | 12/1979 | Bowen | |
| 4,267,607 | A | * | 5/1981 | Tino | 2/409 |
| 4,728,538 | A | | 3/1988 | Kaspar | |
| 5,497,513 | A | | 3/1996 | Arabeyre | |
| 5,729,836 | A | * | 3/1998 | Ewing | 2/409 |
| 5,790,984 | A | | 8/1998 | Doubleday | |
| 5,930,838 | A | | 8/1999 | Carter-Scott-Pomije | |
| 6,059,834 | A | | 5/2000 | Springs | |
| 6,061,832 | A | | 5/2000 | Morrison | |
| 6,276,176 | B1 | * | 8/2001 | Blakely | 66/178 R |
| 6,463,765 | B2 | * | 10/2002 | Blakely | 66/178 R |

OTHER PUBLICATIONS http://girdlebound.safeshopper.com Young Smoothie 6828 Hi–waist Long leg with seat lift.*
http://biggerbras.com/collection_shapewear_girdles_02.s Control and Shaping Girdles Diet minded panty Girdle with Zipper style 6228.*
http://www.justmysize.com see figures.*
http://www.nordstrom.com Spanx Footless Pantyhose.*

* cited by examiner

*Primary Examiner*—John J. Calvert
*Assistant Examiner*—Alissa L. Hoey
(74) *Attorney, Agent, or Firm*—Technoprop Colton LLC

(57) ABSTRACT

An undergarment that functions to shape and smooth a wearer's body profile that encircles the wearer's body from a point between the wearer's knees and upper thighs to a point between the wearer's waist and bust; and that includes an upper friction band at the upper peripheral edge to help ensure that the undergarment remains in place about the torso, a similar lower friction band to maintain the undergarment in place about the legs, a buttocks shaping or lifting means, a pleated crotch opening that can be reversibly opened and closed for facilitation of urination, and hose.

7 Claims, 9 Drawing Sheets

UNDERGARMENT

BACKGROUND OF THE INVENTION

1. Technical Field

The present invention generally relates to female undergarments and more specifically relates to a class of undergarments of the type that helps to shape the wearer's body profile so as to create a smooth and elegant look when clothed by extending on the wearer from a lower point between the wearer's knees and thighs to an upper point between the wearer's waist and bust. Embodiments of the present invention include an undergarment that helps to shape a wearer's mid-section, buttocks and optionally the wearer's thighs, and an undergarment and hose combination that comprises the undergarment mentioned previously in combination with hose. The device or the device combination can be put on quickly; preferably comprises a pleated crotch opening to allow the wearer to urinate without removing the undergarment; and comprises a supporting friction band at the upper and/or lower peripheral edges.

2. Prior Art

Undergarments are expected not only to protect sensitive areas on a wearer's body, but in some circumstances to contour a wearer's body profile to a more desired shape. Specifically, certain undergarments, such as a girdle or corset, can shape a wearer's figure by slimming the waist and/or thighs and lifting the buttocks and/or bust into a more desired shape. The use of such undergarments is particularly important under elegant and formal outer garments (such as dresses) because such undergarments not only shape a wearer's body, but also provide a smooth contour for the body, which adds to the aesthetics of the elegant outer garment (many or most of which are designed to accent or highlight certain parts of the body). Further, because importance of appearance cannot be understated (whether fortunate or not), the prior art discloses an array of undergarments.

U.S. Pat. No. 3,746,009 to Cuozzi discloses a panty girdle including a derriere panel that provides buttocks control and covers a wearer's body. The Cuozzi '009 device also has a crotch opening. However, because the Cuozzi '009 device has straps and incorporates an additional panel for buttocks control, it can be difficult to manufacture and cannot be worn clandestinely with a strapless or other elegant dress.

U.S. Pat. No. 5,790,984 to Doubleday discloses a substantially unitary jumpsuit and undergarment for women and has a concealed closable crotch opening. However, because the device in Doubleday '984 also has straps and lacks a buttocks shaping means, it also cannot be worn clandestinely with a strapless or other elegant dress and cannot shape a wearer's buttocks.

U.S. Pat. No. 6,061,832 to Morrison, Jr. discloses an undergarment system that includes a portion for covering a lower half of a torso and at least another portion integrally coupled to the torso portion. The Morrison '832 device includes an elastic sleeve with elasticity greater than the undergarment only in the midsection of the undergarment. As a result, the Morrison '832 device only applies elastic force to the midsection of a wearer and provides very little in terms of overall contouring a wearer's buttocks or profile.

U.S. Pat. No. 6,298,486 to Huang discloses an undergarment for contouring a body being made from stretchable material, having straps, having complex stitching on the front and rear of the undergarment, and having a zipper on the lateral side. Although the Huang '486 device also has a buttocks shaping means, this means requires complex seam stitching and when worn produces an unnatural heart-shaped buttocks. Further, because Huang '486 discloses a device that has straps, a zipper and complex stitching, the Huang '486 device cannot be put on easily, cannot be worn with a strapless or other elegant dress, and cannot be easily manufactured.

Notwithstanding the prior art, there is a need for an undergarment device that can shape and smooth a wearer's profile without harming the wearer. There also is a need for an undergarment that can be worn clandestinely underneath a garment without negatively affecting the aesthetics of the garment. There is a further need for an undergarment that incorporates essentially straights seams and a limited numbers of seams for easier manufacture. The present invention is directed to such needs.

BRIEF SUMMARY OF THE INVENTION

Briefly, the present invention is an undergarment that functions to shape and smooth a wearer's body profile. The undergarment of the present invention can be made from an elastic or elastic containing material that applies pressure on a wearer's body through the tension forces of the elastic material. One embodiment of the structure encircles the wearer's body from a point between the wearer's knees and upper thighs to a point between the wearer's waist and bust. As one embodiment of the structure is strapless, the undergarment can include an upper friction band, such as a lace band impregnated with a slip-resistant material, at the upper peripheral edge to help ensure that the undergarment remains in place about the torso. Likewise, the undergarment can include a similar lower friction band to maintain the undergarment in place about the legs. Further, the undergarment also can include a buttocks shaping or lifting means, and a pleated crotch opening that can be reversibly opened and closed for facilitation of urination.

The undergarment has the general shape of a common panty girdle and generally fits over and encircles the torso and buttocks of a wearer. The material of manufacture is a lightweight, soft, comfortable material that is elastic or contains elastic. The portion of the undergarment encircling the torso has a control feature (namely the elasticity) that gently shapes and smoothes the wearer's torso. The portion of the undergarment encircling the buttocks (and hips) has a similar control feature to shape and smooth the buttocks and hips. Further, the area of the undergarment between the buttocks comprises a vertically oriented structure to help lift and further shape the buttocks and to help counteract the flattening side affect the elasticity of the undergarment material often has. The portion of the undergarment encircling the thighs or each thigh also has a similar control feature to shape and smooth the thighs.

As it is an object of the present invention to shape and smooth the wearer's body profile, the elastic properties of the undergarment should be strong enough to do the shaping and smoothing, but not so strong as to cause the wearer's body to bulge out above, below or within the undergarment. Because of this, in some circumstances, the upper portion of the undergarment may tend to slide downwards from the bust to the waist and/or the lower portion of the undergarment may tend to slide upwards from the thighs to the crotch. To help prevent this from happening, either or both of the upper peripheral edges of the undergarment are provided with a friction band comprising a support structure impregnated with a slip resistant material. The preferred support structure is a cloth material, such as lace, and the preferred slip-resistant material is an inert, non-toxic, non-irritating material, such as silicone, impregnated into the support structure.

One embodiment of the present invention is to wear underneath formal dresses, which creates several problems that the present invention solves. Formal garb often is backless, strapless or both. The present invention is strapless and stops below the bust or supports the bust from below and is not visible under a strapless dress. Further, the present invention can be made in a backless or low cut back embodiment, as one object is to shape and smooth the waist and buttocks, and in this embodiment is not visible under a backless or low cut back dress.

Another embodiment of the present invention further comprises hose so as to create an undergarment-hose (or pantyhose-type) combination. The hose also can comprise a frictional band about the upper peripheral edges (that is, about the thigh region) allowing the hose to frictionally engage the wearer's thigh or the frictional band about the lower edges of the undergarment. This creates a combination device that allows a quick and easy change of hose (for example, for a change of color or texture), to remove the hose entirely, or to replace damaged hose, while still providing a secure and comfortable device for maintaining the hose in a desired position and controlling the shape of the torso.

Therefore, a feature of the present invention is an undergarment with one use being to shape the body profile of a wearer with uniformity and comfort.

Another feature of the present invention is an undergarment that has an essentially smooth contour and substantially straight seams.

Another feature of the present intention is an undergarment with a pleated crotch that can allow the wear to urinate without having to remove the undergarment.

Another feature of the present invention is an undergarment that can be optimally put on by a wearer easily by placing her legs into the undergarment, then through the leg compartments, and then pulling the garment up to a desired height.

Another advantage of the present invention is an undergarment that is resistant to movement along a wearer body by the introduction of friction bands with slip resistant material at the peripheral edges of the undergarment.

Another feature of the present invention is an undergarment-hose combination allowing the secure and comfortable maintaining of the hose in a desired position, yet allowing the easy removal or replacement of the hose.

Another feature of the present invention is an undergarment-hose combination having a clip-less and strapless means for securing hose to an undergarment so as to help maintain a smooth transition from the hose to the undergarment that will not show (or will only minimally show) underneath an outer garment, such as a formal dress.

Other features, aspects, and advantages of the invention will become apparent from the following detailed description of the preferred embodiments, taken in conjunction with the accompanying drawings in which like reference numerals represent like components throughout the several views, illustrating by way of example the principles of the invention.

DETAILED DESCRIPTION OF THE PREFERRED EMBODIMENTS

Figure 1:
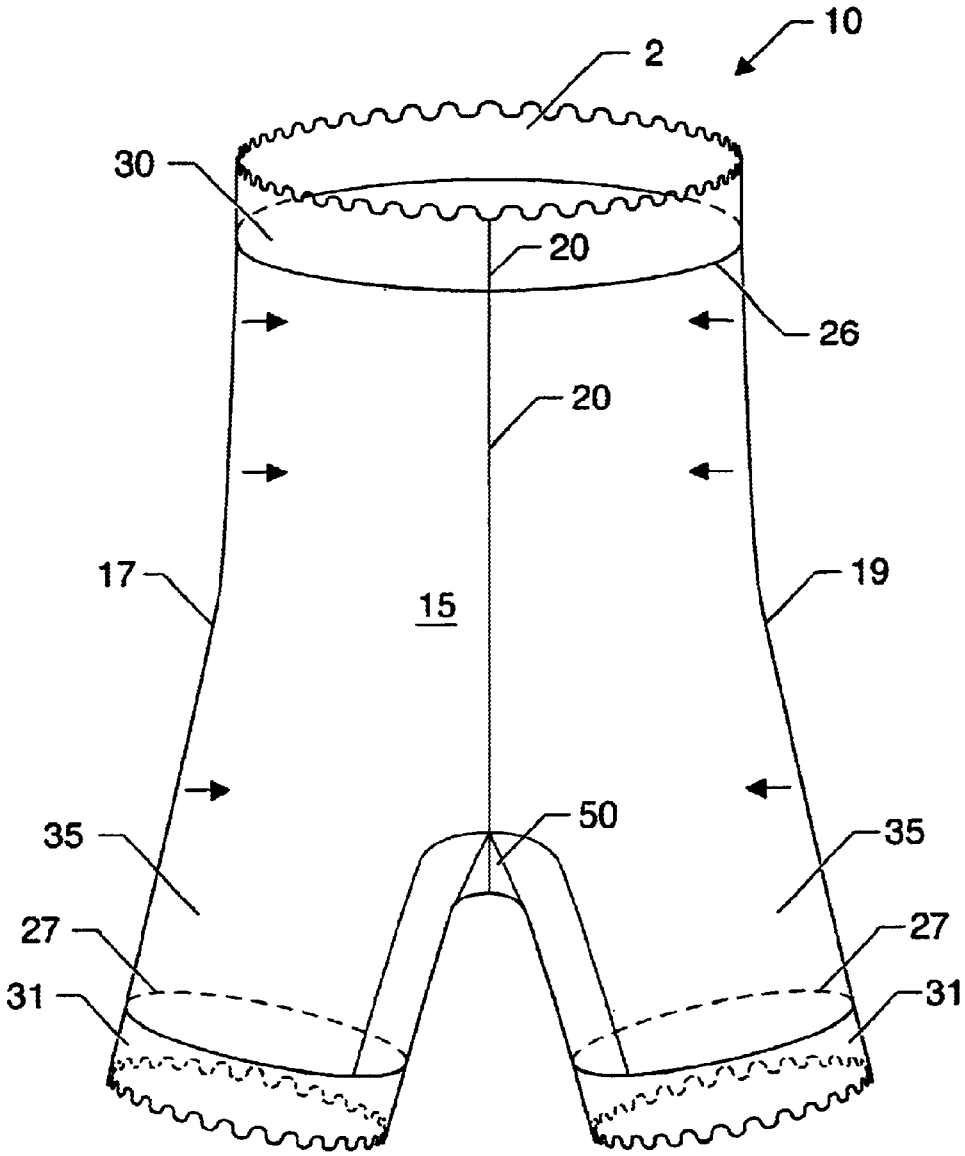
FIG. 1 is a perspective view of the front of one embodiment of the invention.

As shown generally in the FIGs., a preferred embodiment of the present invention is undergarment 10 with front panel 15 and back panel 16 for supporting and shaping a wearer's body profile. Undergarment 10 comprises several pieces connected together, namely left side piece 17, right side piece 19, upper friction band 30, lower friction band 31, and pieces making up reversible opening 50. These pieces typically are stitched together in any conventional fashion. On backside 16, undergarment 10 has buttocks shaping means 22. Although undergarment 10 has front side 15 and backside 16 that are distinct in appearance and function, generally, left side piece 17 and right side piece 19 are mirror images of each other and there is a plane of symmetry centered vertically and perpendicularly to both front side 15 and backside 16 through medial seams 20, 21.

Figure 2:
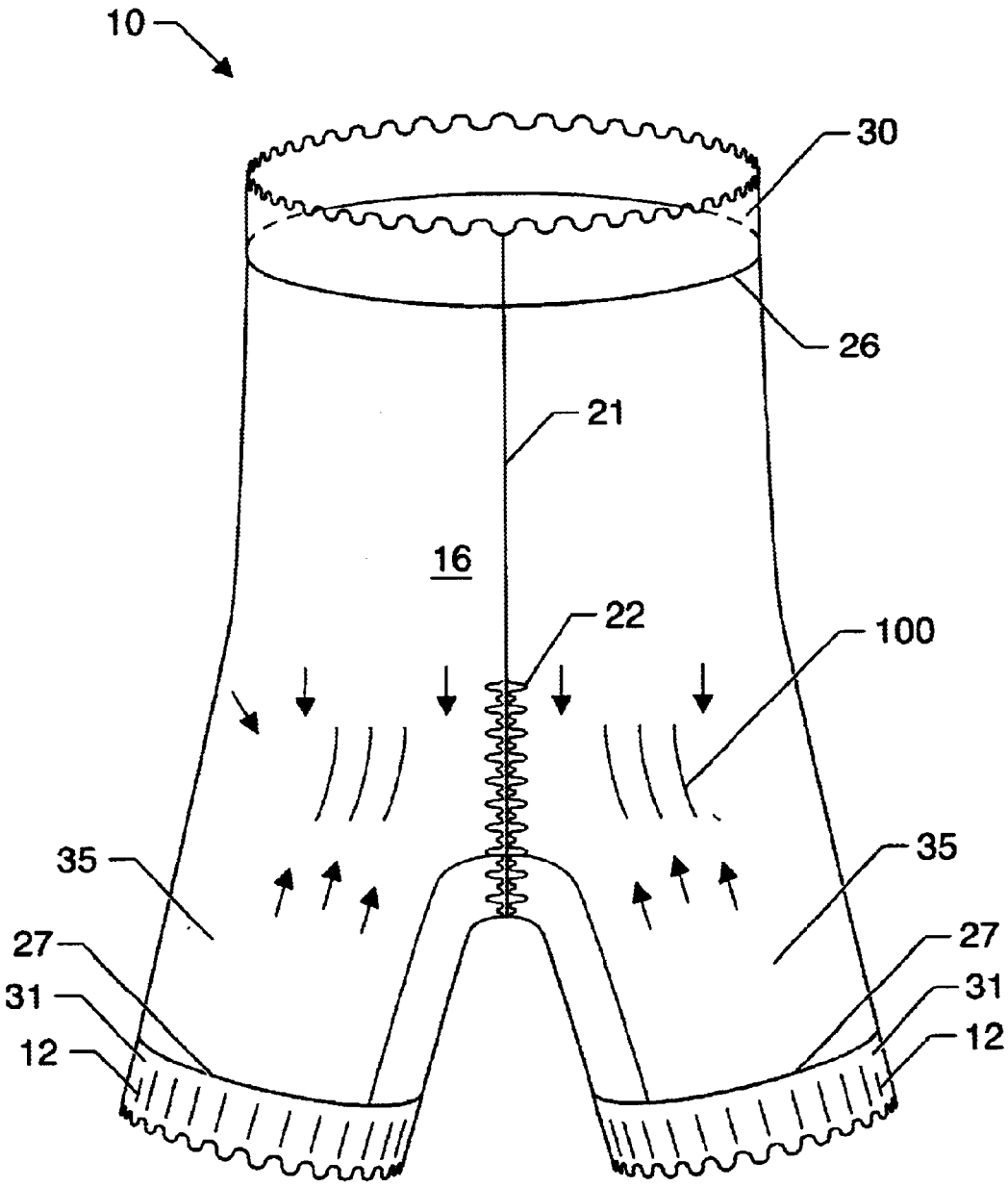
FIG. 2 is a perspective view of the back of one embodiment of the invention.

Referring now to FIGS. 1 and 2, undergarment 10 can be a substantially unitary structure that comprises at least two segments of elastic material that are joined together using two substantially vertical seams, namely front medial seam 20 on front panel 15 and back medial seam 21 on back panel 16 (hereinafter collectively referred to "single medial seams"). Single medial seams can extend from top peripheral edge 26 to reversible opening 50 of front panel 15 and back panel 16. Preferably, front medial seam 20 can be sewn so that it aligns with a wearer's sternum on front panel 15 and back medial seam 21 can be sewn so that it aligns with a wearer's spinal column on back panel 16. Placing single medial seams 20, 21 in these positions disclosed above effectively conceals the seams 20, 21 in natural contours of the wearer's body, which allows undergarment 10 (and consequently the wearer's body) to appear smooth, which is important because most elegant outer garments appear aesthetically best under such conditions. The substantially unitary structure allows undergarment 10 to be worn comfortably and the single medial seams 20, 21 arrangement reduces undergarment's 10 chances of sliding, chafing, and pinching a wearer's body.

Because undergarment 10 is preferably strapless, it relies at least partly on the elasticity of its composition materials to maintain its position on a wearer. Preferably, undergarment 10 is composed of an elastic material that applies compression upon wearer to maintain the position of undergarment 10 on a wearer. For example, Nylon®, Lycra®, Spandex® and cotton materials having elastic components are suitable. Those of ordinary skill in the clothing arts can select appropriate materials.

Further, friction bands 30, 31 with slip-resistant material 12 can help maintain the position of undergarment 10 by enhancing the frictional force between the undergarment 10 and the wearer's body. With the elasticity of the material of undergarment 10 coupled with friction bands 30, 31 with slip-resistant material 12, undergarment 10 is more resistant to movement.

Friction bands 30, 31 with slip resistant material 12, placed at the upper and lower peripheral edges, can vary dimensions. Although it is preferred that the lace 12 be 0.2 inches thick or less, thicker materials can be used for different applications. Further, friction bands 30, 31 can have a width less than ¼ inch or greater than 3 inches for certain situations, but it is contemplated that the vast majority of situations will require a width of between ¼ inch and 3 inches. It is understood that persons with ordinary skill in the art can select varying dimensions to further the aesthetic of undergarment 10.

Friction bands 30, 31 typically are located at the periphery of undergarment 10. Preferably, upper friction band 30 is placed on undergarment 10 at top peripheral edge 26 and lower friction band 31 is placed on undergarment 10 at bottom peripheral edge 27. The preferred slip-resistant material 12 is non-adhesive (defined as material that does to irreversibly bind to skin or the contact surface) and is flexible and elastic to a certain degree in at least the x- and y-axis directions, and preferably in all directions, so that it can be adjusted to fit a wearer and/or her clothing without stretching or breaking. Preferably, the slip-resistant material 12 is a material that has a higher coefficient of friction against skin than undergarment 10 has against the skin. Further, it can be important to select a slip-resistant material that will not deteriorate quickly from normal use or contact with a surface. Slip-resistant material 12 is preferably silicone, but can be other materials such as rubbers, soft plastics, and the like, and is skin compatible (defined as a material that does not cause irritation or damage to the skin and does not cause pain in performing its function).

In more detail, slip-resistant material 12 preferably is a thin layer of material so as to prevent the deformation of the aesthetics of the undergarment 10 and dress, but is thick enough to maintain its integrity. It is preferable that the layer be less than 0.2 inches thick, including the support material, and more preferable that the layer be between 0.01 to 0.01 inches thick. However, the person of ordinary skill in the art can determine the layer's thickness without undue experimentation, depending on the slip-resistant material's properties and the support material. The support material preferably is a thin and relatively strong material capable of supporting the slip-resistant material and being attached to undergarment 10. Laces and cloths are preferred, as these types of materials are commonly used in the garment industry, are comfortable to the wearer, can be made aesthetically pleasing, are relatively strong, and are easily incorporated into undergarment 10.

Friction bands 30, 31 can be provided in just about any dimensions. Although it is preferred that the friction bands 30, 31 be 0.2 inches thick or less, they can be thicker for different applications. For example, for heavier- or heavy-duty undergarments 10 (such as for larger or plus-size people), thicker friction bands 30, 31 based on thicker (heavier gauge) support materials may be indicated. However, for the normal undergarment 10, a thinner support material generally is indicated. Typically, a cloth, cloth-like or lace material being 0.2 inches thick or less, ⅛ inch to 3 inches wide and ¼ inch or more in length is suitable. Friction bands 30, 31 can have a width less than ¼ inch or greater than 3 inches for certain situations, but it is contemplated that the vast majority of situations will require a width of between ¼ inch and 3 inches.

Because many slip-resistant materials 12, such as silicone, lack sufficient strength on their own, the support material preferably is integrated with slip-resistant material 12 to add support and structure. For example, the support material can form a substrate on which the slip-resistant material 12 is layered. Alternatively, slip-resistant material 12 can be deeply or completely impregnated into the support material. It is contemplated that the support material selected and the means for attaching slip-resistant material 12 to the support material can be select for primarily aesthetic reasons. It can be optimal to select a pattern for the support material that can hold or reinforce slip-resistant material 12.

Slip-resistant material 12 can be integrated with the support material by many means. Preferably, slip-resistant material 12 is impregnated into the support material, that is, forced into or onto the support material such that the support material either becomes generally impregnated by slip-resistant material 12, but with a layer of slip-resistant material 12 remaining on at least one side of the support material, or is layered onto the support material, also so that a layer of slip-resistant material 12 remains on at least one side of the support material. One method of integrating slip-resistant material 12 into or onto the support material simply is to coat the support material with slip-resistant material 12. Many common silicone products come in a relatively fluid state, which can be applied to the support material and allowed to air-cure, forming a dry final product. Slip-resistant material 12 can be forced into the support material by the use of a rolling pin or other flattening devices. Excess slip-resistant material 12 can be removed prior to curing by scraping or subsequent to curing by cutting. Other methods of applying such materials to substrates are known in the art.

A continuous slip-resistant surface on friction bands 30, 31 is not necessary for suitable functionality. For example, when friction bands 30, 31 are placed on undergarment 10, the wearer may prefer to have more support material than slip-resistant material 12 touch her skin. In fact, a broken surface of slip-resistant material 12 may reduce chances of the wearer's skin becoming irritated by friction bands 30, 31 by reducing the surface area of slip-resistant material 12 rubbing against the skin of the wearer. However, because slip-resistant material 12 essentially supports undergarment 10 against the contact surface (the wearer's skin), it is necessary to have sufficient slip-resistant material 12 in contact with the contact surface, so to ensure that undergarment 10 is supported adequately against the contact surface.

The means by which friction bands 30, 31 are incorporated onto undergarment 10 can be dependent on the support material used, the slip-resistant material 12 selected, wearer preferences, and tailor preferences, and can be determined without undue experimentation. For example, friction bands 30, 31 can be attached to undergarment 10 by means of sewing, weaving, knitting, or the like. Alternatively, friction bands 30, 31 can be adhered to undergarment 10 by means of an adhesive-like or bonding means, such as flexible glues or resins. If undergarment 10 is a material that can be sewn into easily, it may be optimal to sew friction bands 30, 31 onto undergarment 10. The method to incorporate friction bands 30, 31 onto undergarment 10 is understood by a person of ordinary skill in the art.

Generally, undergarment 10 in a relaxed position is a generally tubular or hour glass shape having a minimum diameter ranging from about 3 inches to about 15 inches, depending on the stretchability of the fabric material. Because undergarment 10 can vary in length over a wide range, undergarment 10 in a relaxed position has a length ranging from about 9 inches to about 60 inches as measured from top peripheral edge 26 to bottom peripheral edge 27. It is preferred that front side 15 be about the same length as backside 16. The exact length of undergarment 10 is variable based on the size of the wearer, the type of outer garment, and the style selected (that is, whether the undergarment 10 extends only to the upper thigh or down to the knee and only to the waist or up to the bust).

It is understood that undergarment 10 can be formed from many types of materials. It is preferred that a tubular fabric material be used in order to avoid any side seams or medial seams 20, 21 and to reduce potential discomfort and visibility under clothes. A stretchable or elastic tubular fabric material that tends to stay in position is desired. In providing a good fit, the material should be stretchable circumferentially, longitudinally, and horizontally. Such materials can include cotton fabric and polyester fabrics. A lightweight fabric is preferred and the fabric can be doubled in thickness for increased comfort and control. Although any desired coloration can be used, the colors typically are selected in the clothing industry to allow concealment of undergarment 10 under the outer garment. It is preferred that an elastic fabric material that tends to be comfortable and return back to original position after stretching be used.

Figure 3:
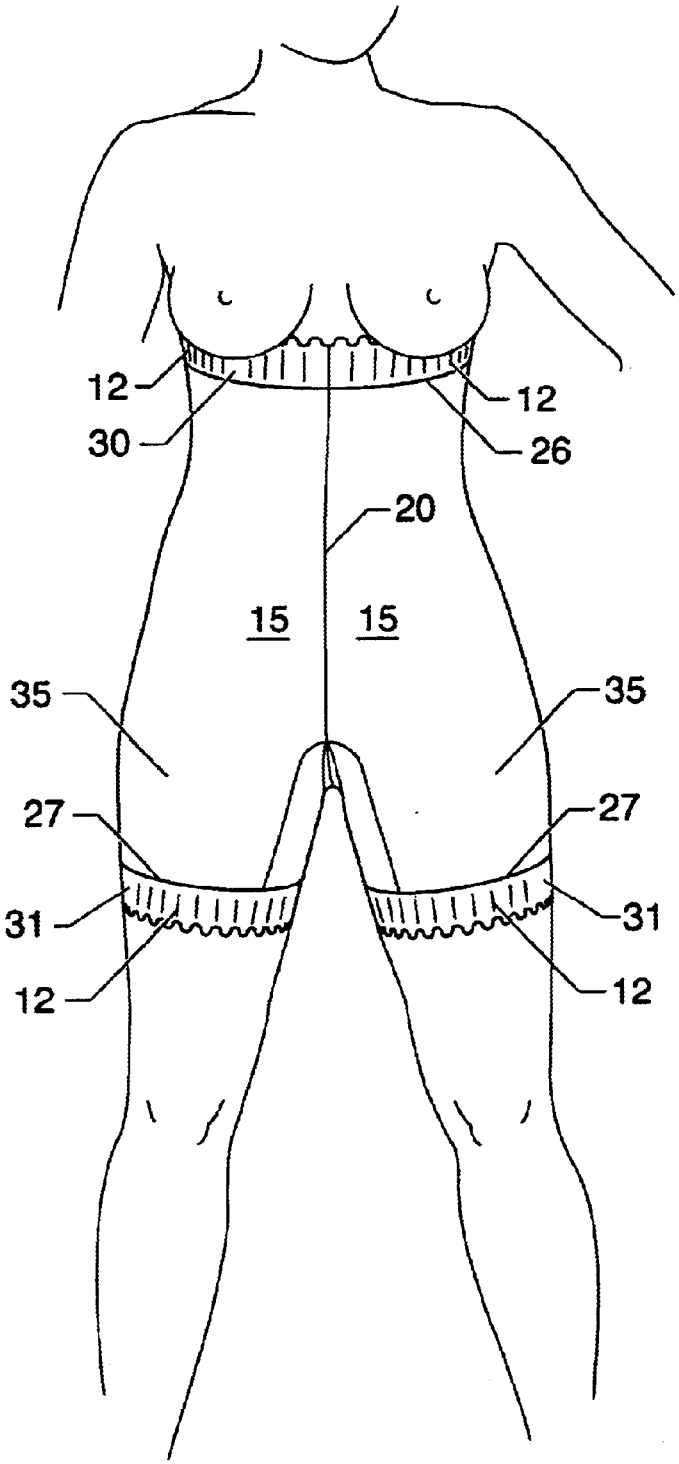
FIG. 3 is a perspective view from the front of one embodiment of the invention on a wearer.
Figure 4:
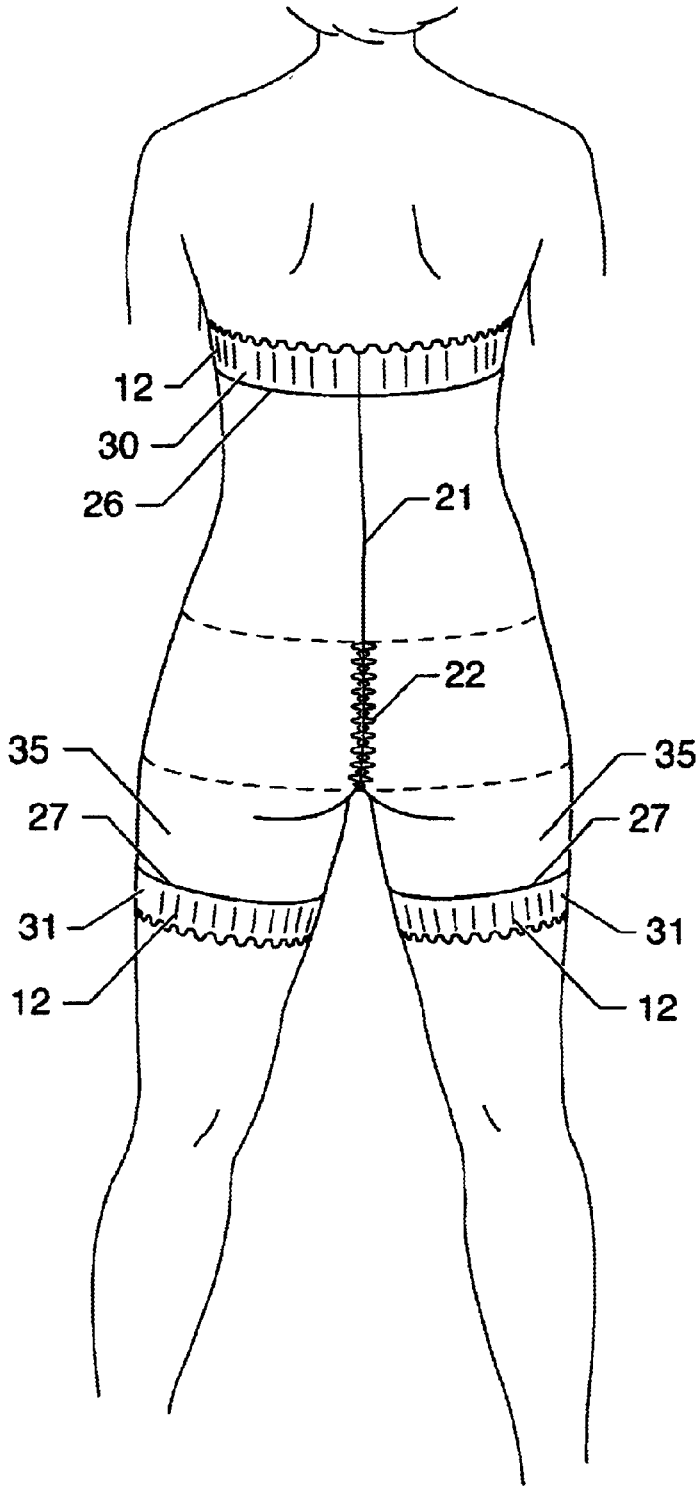
FIG. 4 is a perspective view from the back of one embodiment of the invention on a wearer.

The wearing of undergarment 10 is obvious from its structure. Because the described features of undergarment 10, a wearer can easily and quickly put it on by stepping through upper port 2, then stepping into leg sections 35, then pulling undergarment 10 over a wearer's buttocks and crotch areas up to a wearer's bust-line region. Referring now to FIGS. 3 and 4, when undergarment 10 is worn, it is apparent that front panel 15 corresponds to a wearer's front side and back panel 16 corresponds to a wearer's backside. On a wearer from a front view, as shown in FIG. 3, one embodiment of undergarment 10 extends from as far upwards as the region flanking a wearer's breasts and as far downwards as a wearer's thigh region. Generally, top peripheral edge 26 is preferably positioned between about 1 inches and about 3 inches below the armpit of a wearer, and just below the wearer's bust. However, in certain embodiments, friction band 30 can extend beyond the bust-line. It is contemplated that the upper section of back panel 16 can be altered to reduce visibility when worn with a low-backed dress. Additionally, undergarment 10 is worn preferably so that reversible-opening 50 aligns with the groin region of a wearer for facilitation of urination.

Figure 5:
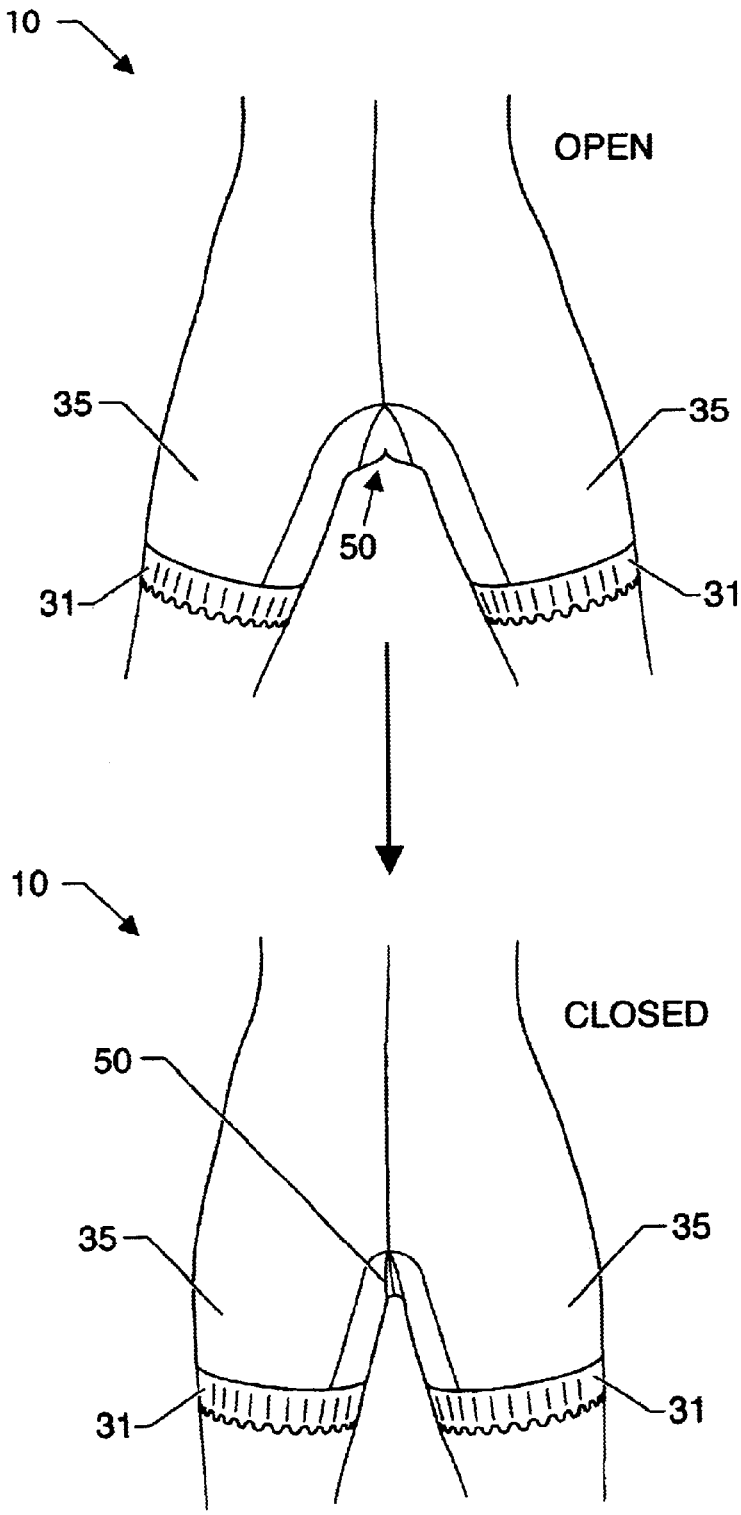
FIG. 5 is a sequential view of the reversible opening aspect of one embodiment of the invention on a wearer.

As shown in FIG. 5, undergarment 10 can have pleated reversible opening 50 for facilitation of urination. When the legs of a wearer are closer together, the pleat remains closed; and when the legs are further apart, the pleat spreads apart. Reversible opening 50 can be a pleated fold that can be opened and closed to facilitate urination as desired by a wearer. A wearer can also manually move the pleat when it is so desired or for facilitation of urination. Other methods of controlling reversible opening 50 can be used, such a zipper, and are known to the person of ordinary skill in art.

Figure 6:
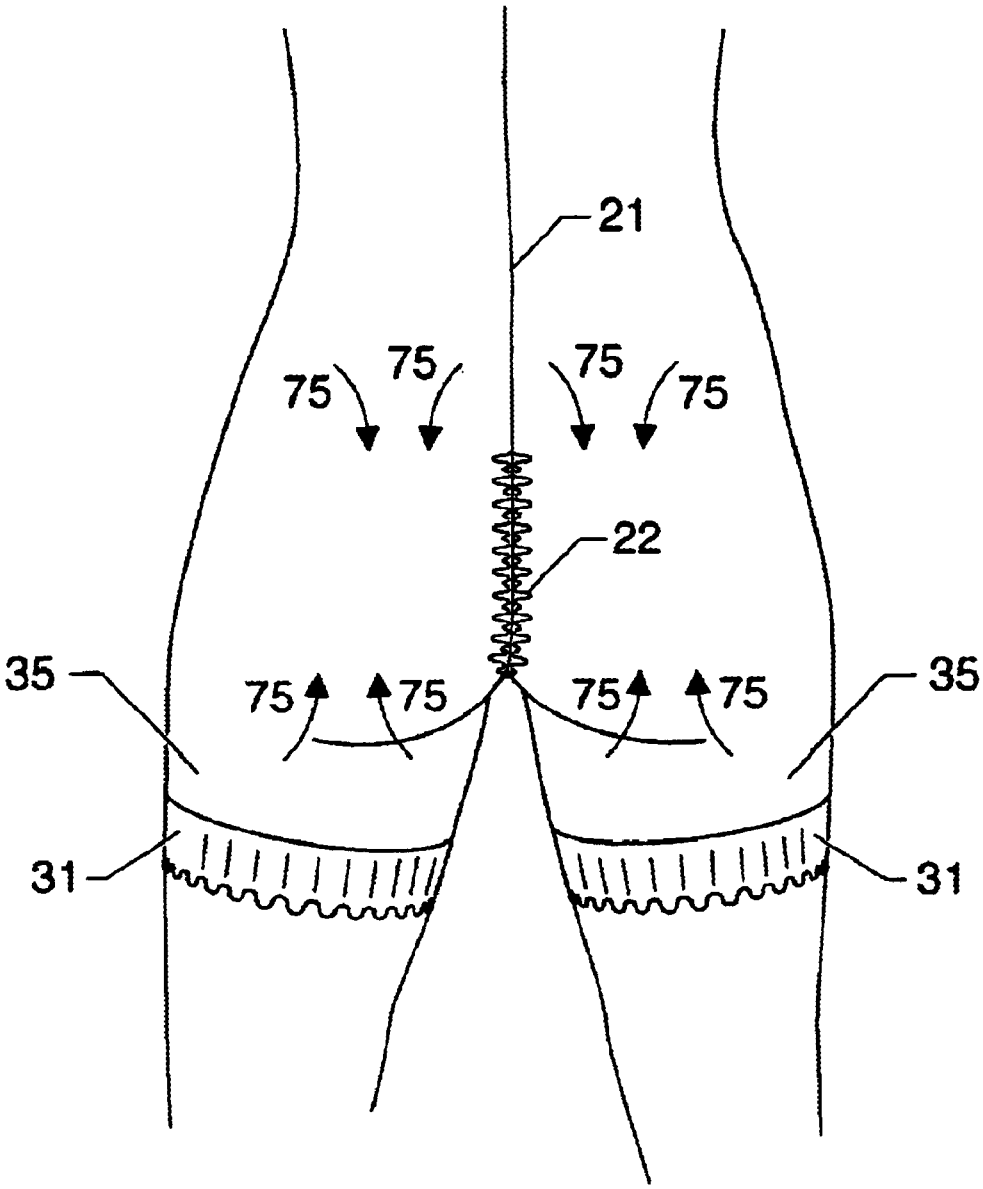
FIG. 6 is a plan view of the buttocks shaping aspect of one embodiment of the invention on a wearer.

From a back view as shown in FIG. 6, undergarment 10 can extend as far upwards as a wearer's upper back region and as far downwards as a wearer's lower thigh or knee region. FIG. 6 further details a feature of undergarment 10 that can enhance of the shape of the wearer's buttocks. Preferably, a wearer's buttocks fit within buttocks shaping means 22 for a comfortable fit. As shown by the arrows 100, buttocks shaping means 22 can be a means that creates slack 100 in the material along back medial seam 21 in the buttocks region. More specifically, buttocks shaping means is a series of stitches that bunch the fabric of back panel 16 in the region between the two hemispheres of the buttocks (between the two gluteus maximus muscles). This pulls the fabric covering the buttocks upwards, thus lifting the buttocks and causing them to protrude outwards. Buttocks shaping means also has an aspect to prevent slack 100 from shifting to other regions of undergarment 10 when worn. This mechanism functions to allow the amount material of undergarment 10 diverted to the buttock region to be elevated with respect to other areas, and for allows more protruded and shaped buttocks to be achieved when worn. Further, because the enhanced buttocks are created without introducing another seam, a smoother and more aesthetically pleasing shape is achieved without compromising the outer garment.

Lower friction band 310 with its slip-resistant material 12 and the elasticity of undergarment 10 also can serve to secure hose. More specifically, hose can be secured by placing the top edge of the hose underneath lower friction band 31 (that is, between lower friction band 31 and the wearer's leg). The slip-resistant material 12 and/or the elastic quality of undergarment secures hose against the wearer's leg. More specifically, slip-resistant material 12 rests over and contacts the upper edge of the hose and provides a force to keep the hose in place. Additional security for the hose can be obtained from the compression force of the elastic material of undergarment 10 applied to the pantyhose.

Another advantage of the preferred embodiments of the invention is that it can be manufactured relatively simply and easily. This advantage arises partially because the seams are substantially straight, if seams are used, or that the entire main body of the invention can be made from a tubular piece of material. Straighter seams are easier, simpler, and quicker to incorporate into a garment than curved seams. Further, buttocks shaping means 22 is sewn as a substantially straight seam.

It is understood by persons of ordinary skill in the art that the optimal dimensions, sizes, and materials for the invention depend on the size of the wearer, manufacturing materials, and aesthetics or design of the outer garment, just like any other piece of clothing. Preferably, one size of the undergarment is intended to fit most people within a range of sizes, wherein the elasticity of the material allows undergarment 10 to fit around wearers of various thickness and shape. Such parameters for the present invention can be determined without undue experimentation.

Figure 7:
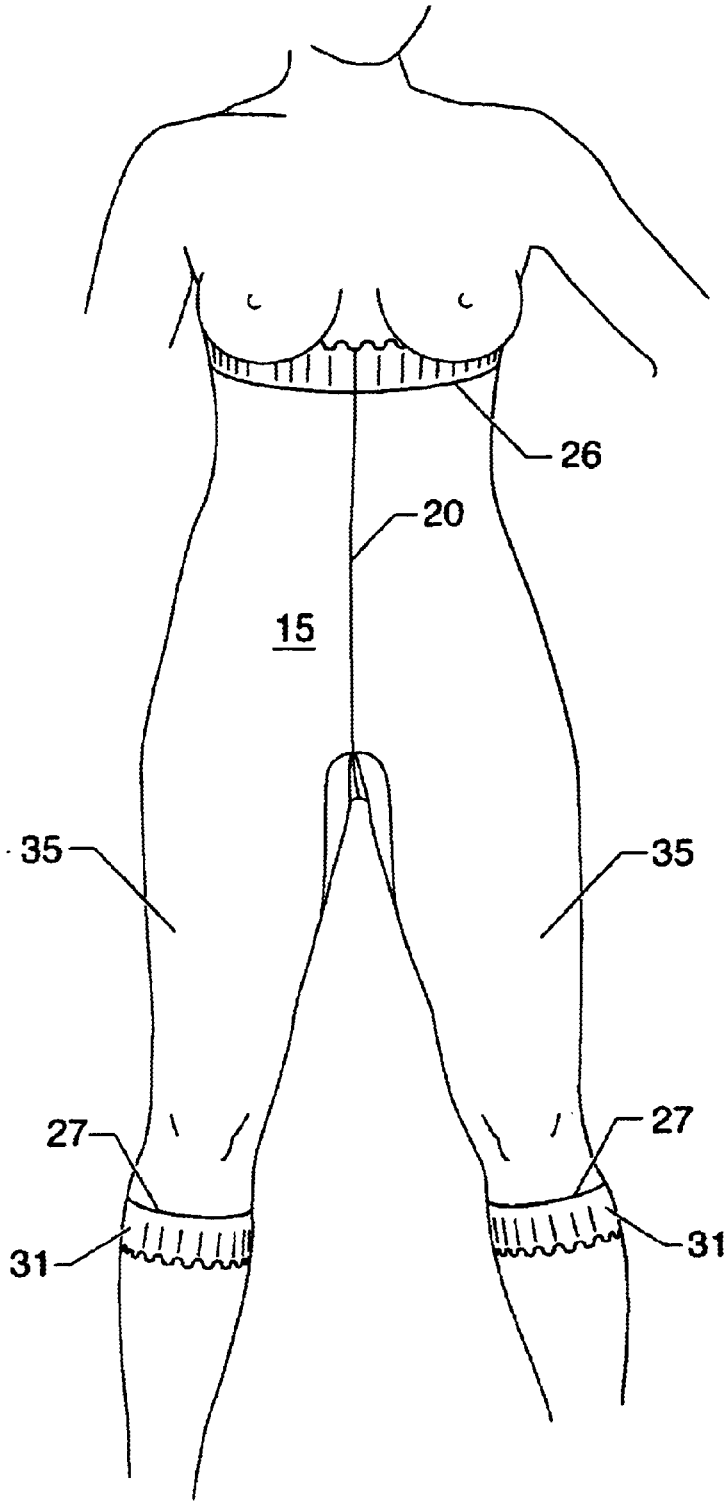
FIG. 7 is plan view of an alternative embodiment of the invention.

FIG. 7 depicts an alternative embodiment of the present invention in which undergarment 10 extends down beyond a wearer's knees. Legs sections 35, as extended, allow for a more even compression of a wearer's lower body and for a more even body tissue distribution in a wearer's thigh region. Similar to the other embodiments, undergarment 10 flanks a wearer's bust line and has buttocks shaping means 22. However, it should be appreciated that many equivalent variations, particularly in the length of the leg sections, exist which are suitable.

FIGS. 8–11 illustrate a combination of undergarment 10 and hose 40 that provides more complete undergarment coverage for the wearer. The undergarment component is preferably the undergarment 10 discloses previously. The hose component generally is common hose, such as silk or Nylon® hose, or any other hose material. Leg-only hose (that is, without a panty portion) are preferred, as the undergarment 10 provides the panty feature. Further, hose 40 with or without feet are suitable for use.

Figure 8:
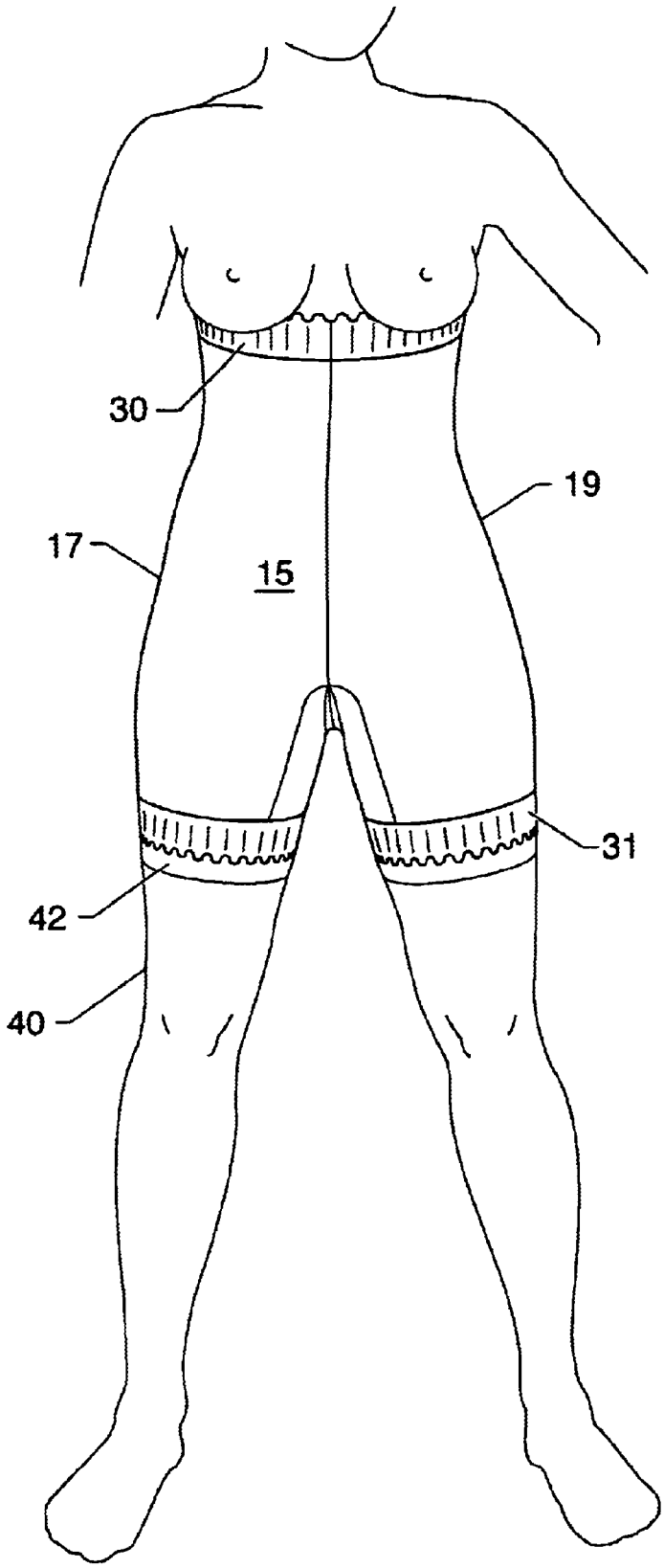
FIG. 8 is a perspective view of an alternate embodiment of the invention in combination with hose.

FIG. 8 illustrates the overall arrangement of the invention on a wearer. Generally, undergarment 10 is worn over the torso and a portion of the thighs of the wearer. Hose 40 are pulled on over the legs 44 of the wearer. Hose 40 are constructed so as to be a length generally equal to the length of the leg 44 up to the lowest point of undergarment 10. This allows hose 40 to extend upwards the proper distance on leg 44 and to engage undergarment 10 without bunching, sagging or having wrinkles about leg 44. As can be seen in FIG. 8, the combination of undergarment 10 and hose 40 creates a complete undergarment solution from the bust line to the feet.

Figure 9:
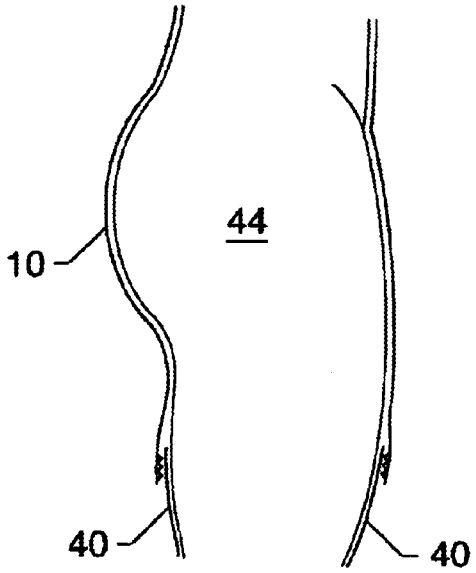
FIG. 9 is a cross-sectional view of the embodiment shown in FIG. 8 showing the undergarment-hose cooperation arrangement using hose without a friction band.

FIG. 9 is a cross-section of a first embodiment of undergarment 10 and hose 40 combination on a wearer's leg 44. In this embodiment, undergarment 10 comprises friction band 31 while hose 40 does not. The upper edge of hose 40 is placed underneath friction band 31, that is, between friction band 31 and leg 44. The combination of the friction created by slip resistant material 12 on or in friction band 31 and the compression created by the elastic material of undergarment 10 or support material holds hose 40 between friction band 31 and leg 44, thus keeping hose 40 in a desired position.

Figure 10:
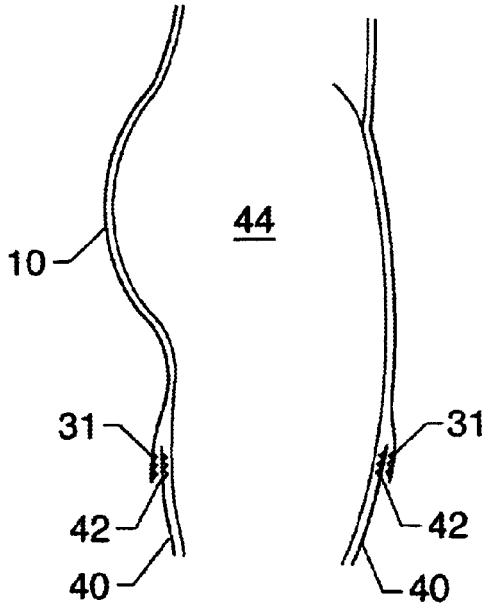
FIG. 10 is a cross-sectional view of the embodiment shown in FIG. 8 showing the undergarment-hose cooperation arrangement using hose with a friction band facing the leg.

FIG. 10 is a cross-section of a second embodiment of undergarment 10 and hose 40 combination on a wearer's leg 44. In this embodiment, undergarment 10 comprises friction band 31 and hose comprises friction band 42. Hose friction band 42 is of the same general structure as undergarment friction band 31. Friction band 42 is located about the upper peripheral edge of hose 40, and can be sewn on (or attached by an conventional means) or can be incorporated into the upper edge of hose 40, much like as disclosed previously for undergarment 10. In the embodiment shown in FIG. 10, slip resistant material 12 on friction band 42 faces inwardly (that is, towards from leg 44). Friction band 42 is placed underneath friction band 31, that is, between friction band 31 and leg 44. Friction band 42 cooperates with leg 44 and friction band 31 cooperates with the outer surface of hose 40. The combination of the friction created by slip resistant material 12 of friction band 42 against leg 44, slip resistant material 12 of friction band 31 against hose 40, and the compression created by the elastic material of undergarment 10 or support material holds hose 40 between friction band 31 and leg 44, thus keeping hose 40 in a desired position.

Figure 11:
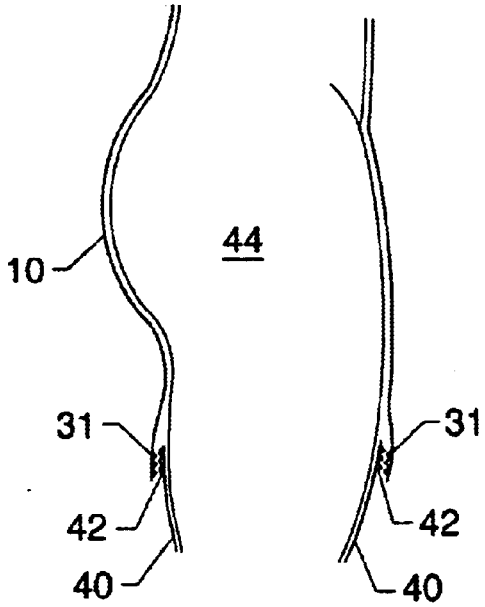
FIG. 11 is a cross-sectional view of the embodiment shown in FIG. 8 showing the undergarment-hose cooperation arrangement using hose with a friction band facing the undergarment.

FIG. 11 is a cross-section of a third embodiment of undergarment 10 and hose 40 combination on a wearer's leg 44. In this embodiment, undergarment 10 also comprises friction band 31 and hose also comprises friction band 42. As disclosed immediately above, hose friction band 42 is of the same general structure as undergarment friction band 31 and friction band 42 is located about the upper peripheral edge of hose 40, and can be sewn on (or attached by an conventional means) or can be incorporated into the upper edge of hose 40, much like as disclosed previously for undergarment 10. In the embodiment shown in FIG. 11, slip resistant material 12 on friction band 42 faces outwardly (that is, away from leg 44). Friction band 42 is placed underneath friction band 31, that is, between friction band 31 and leg 44. Friction band 42 cooperates with friction band 31. The combination of the friction created by slip resistant material 12 of friction band 42 against slip resistant material 12 of friction band 31, and the compression created by the elastic material of undergarment 10 or support material holds hose 40 between friction band 31 and leg 44, thus keeping hose 40 in a desired position.

Figure 12:
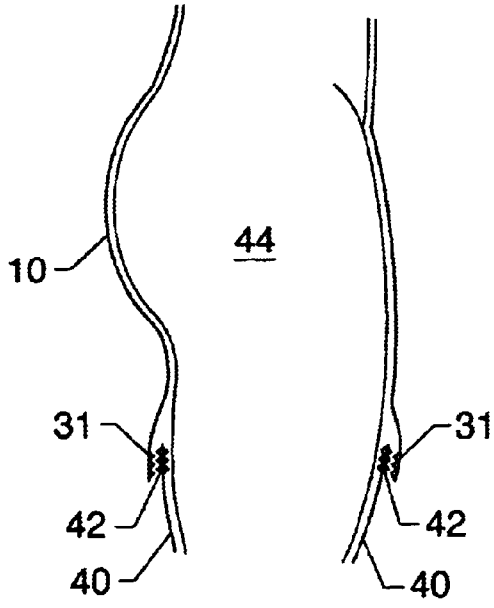
FIG. 12 is a cross-sectional view of the embodiment shown in FIG. 8 showing the undergarment-hose cooperation arrangement using hose with a friction band facing both the undergarment and the leg.

FIG. 12 is a cross-section of a fourth embodiment of undergarment 10 and hose 40 combination on a wearer's leg 44. In this embodiment, undergarment 10 also comprises friction band 31 and hose also comprises friction band 42. As disclosed immediately above, hose friction band 42 is of the same general structure as undergarment friction band 31 and friction band 42 is located about the upper peripheral edge of hose 40, and can be sewn on (or attached by an conventional means) or can be incorporated into the upper edge of hose 40, much like as disclosed previously for undergarment 10. In the embodiment shown in FIG. 12, slip resistant material 12 on friction band 42 faces both inwardly outwardly (that is, both towards and away from leg 44). Friction band 42 is placed underneath friction band 31, that is, between friction band 31 and leg 44. Friction band 42 cooperates both with friction band 31 and with leg 44. The combination of the friction created by slip resistant material 12 of friction band 42 against slip resistant material 12 of friction band 31, the friction created by slip resistant material 12 of friction band 42 against leg 44, and the compression created by the elastic material of undergarment 10 or support material holds hose 40 between friction band 31 and leg 44, thus keeping hose 40 in a desired position.

The above disclosure and representative examples are meant to be illustrative of the invention and not to limit the scope or spirit as defined by the appended claims and their equivalents.

What is claimed is:

1. A unitary, strapless undergarment, with a front side having a front panel backside, and a groin region, for supporting and shaping the profile of a wearer comprising:

a. buttocks shaping means;

b. frictional securing means;

c. a pleated opening in the groin region of the undergarment;

d. a single front medial seam along the front panel; and e. a single back medial seam along the backside, wherein the top edge of the undergarment extends as far up as the region of the wearer flanking the bust-line and as far down as the upper thigh region of the wearer and can be worn clandestinely under an outer garment, and is substantially smooth; the frictional securing means comprises a slip-resistant material relative to the skin of the wearer; and the buttocks shaping means is a series of vertical stitches in the material of the undergarment substantially between the buttocks and allows for an enhanced buttocks by lifting the material of the undergarment in the buttocks region.

2. The undergarment as claimed in claim 1, wherein the single back medial seam is positioned to run along the spinal column of the wearer.

3. The undergarment as claimed in claim 1, wherein the single front medial seam is positioned to run along the sternum of the wearer.

4. The undergarment as claimed in claim 1, wherein the frictional securing means comprises a flexible material substrate impregnated with the slip-resistant material.

5. The undergarment as claimed in claim 1, wherein the flexible material substrate is a cloth and the slip-resistant material is a silicone.

6. The undergarment as claimed in claim 1, whereby the buttocks shaping means comprises a medial seam that maintains a relaxed state along the backside in the buttocks region.

7. The undergarment as claimed in claim 1, wherein the bottom edge of the undergarment comprises frictional securing means.

* * * * *